United States Patent [19]

Morris et al.

[11] Patent Number: 4,843,359

[45] Date of Patent: Jun. 27, 1989

[54] MOLDED CASE CIRCUIT BREAKER HANDLE FOR AUTOMATED ASSEMBLY

[75] Inventors: Robert A. Morris, Burlington; Roger N. Castonguay, Terryville, both of Conn.

[73] Assignee: General Electric Company, New York, N.Y.

[21] Appl. No.: 179,809

[22] Filed: Apr. 11, 1988

[51] Int. Cl.[4] ..... H01H 75/00

[52] U.S. Cl. ..... 335/6; 335/202; 335/132

[58] Field of Search ..... 335/6, 8–10, 335/201, 202, 131, 132; 200/293–304

[56] References Cited

U.S. PATENT DOCUMENTS

| | | | |
|---|---|---|---|
| 2,989,604 | 6/1961 | Wegh | 335/6 |
| 4,266,209 | 5/1981 | DiMarco et al. | 335/6 |
| 4,679,019 | 7/1987 | Todaro et al. | 335/172 |
| 4,733,211 | 3/1988 | Castonguay et al. | 335/192 |
| 4,736,174 | 4/1988 | Castonguay et al. | 335/167 |

*Primary Examiner*—E. A. Goldberg
*Assistant Examiner*—Lincoln Donovan
*Attorney, Agent, or Firm*—Richard A. Menelly; Walter C. Bernkopf; Fred Jacob

[57] ABSTRACT

A circuit breaker operating handle formed from a plastic composition includes a handle access post and a curvilinear handle skirt. A pair of opposedly positioned detent members are integrally-formed on the surface of the handle skirt opposite the handle access post. The detents correspondingly engage the top planar surface of a U-shaped handle yoke which interfaces with the circuit breaker operating mechanism. The circuit breaker operating handle is robotically down-loaded onto the handle operating yoke prior to attachment between the handle yoke and the circuit breaker operating mechanism.

12 Claims, 3 Drawing Sheets

Fig.5.

PRIOR ART

MOLDED CASE CIRCUIT BREAKER HANDLE FOR AUTOMATED ASSEMBLY

BACKGROUND OF THE INVENTION

Molded case circuit breakers for both residential and industrial applications are currently designed for automated assembly to substantially reduce their manufacturing costs. U.S. Pat. Nos. 4,679,019 and 4,736,174 describe such circuit breaker operating components that are specifically tailored for robotic assembly.

When molded case circuit breakers are equipped with an electronic trip unit arranged on a planar printed wire board assembly, the circuit breaker operating handle is modified to provide clearance between the inside of the circuit breaker cover and the top surface of the printed wire board in order to facilitate movement of the operating handle between the "ON" and "OFF" positions. U.S. patent application Ser. No. 060,576 filed June 11, 1987 entitled "Molded Case Circuit Breaker with Contact Status Indicating Handle" describes one such circuit breaker handle configuration. However, the aforementioned operating handle assembly requires an additional process step for attachment to the handle yoke assembly. It would accordingly be beneficial to attach the circuit breaker operating handle to the handle yoke such that the combined operating handle and handle yoke can be assembled to the circuit breaker operating mechanism in a single operation.

One purpose of the instant invention is to describe a circuit breaker operating handle assembly used with electronic trip units and which includes means for attachment to the handle yoke prior to the assembly of the handle yoke to the circuit breaker operating mechanism in a high speed automated assembly process.

SUMMARY OF THE INVENTION

A plastic circuit breaker operating handle includes an integrally-formed upright access post formed integrally with a curvilinear handle skirt member. A pair of detents formed on the bottom surface of the skirt member mechanically interlock a part of the handle yoke to thereby allow the handle and yoke to be robotically assembled to the circuit breaker operating mechanism in a single manufacturing step.

DESCRIPTION OF THE PREFERRED EMBODIMENT

Figure 1:
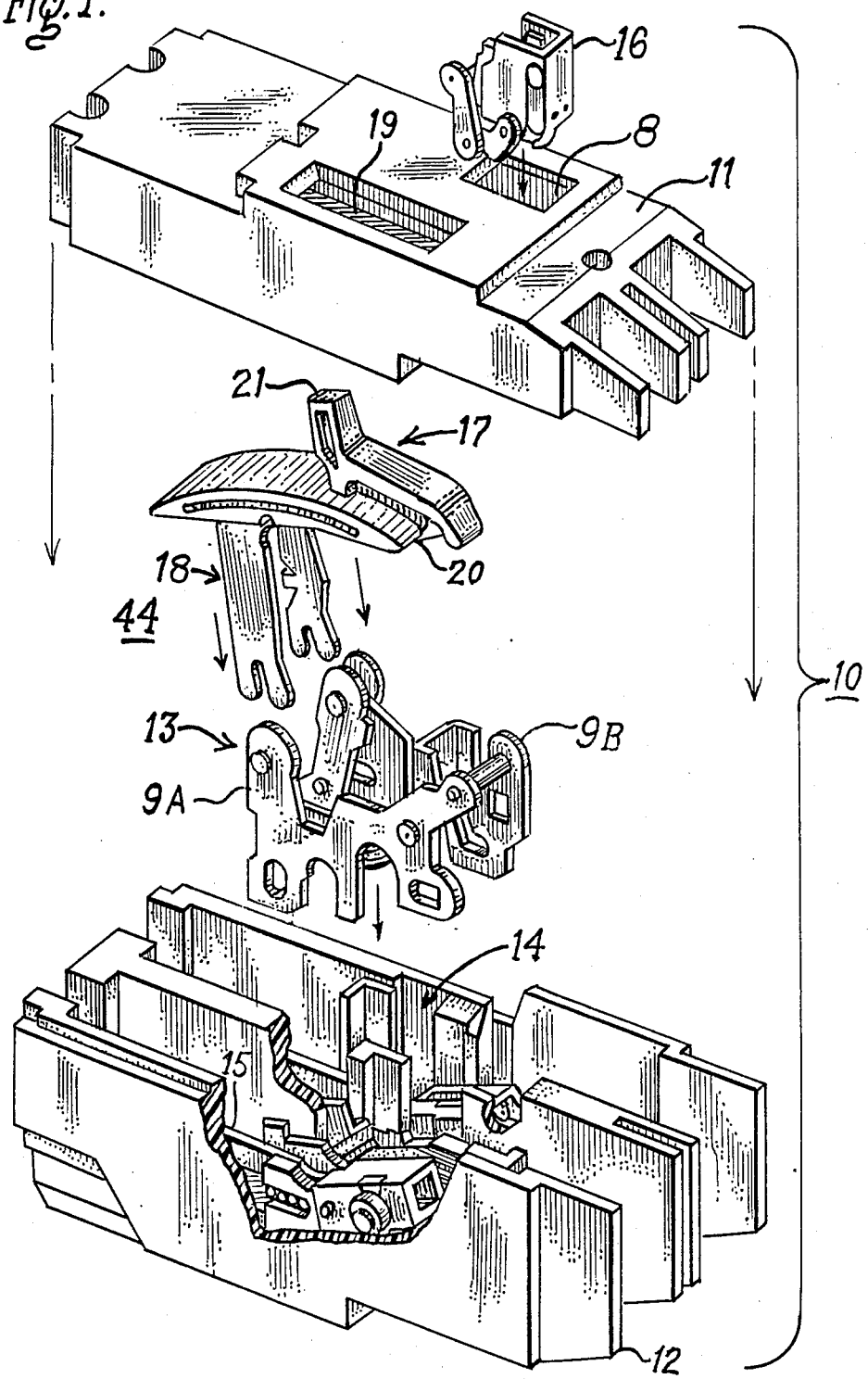
FIG. 1 is a top perspective view of a molded case circuit breaker designed for automated assembly.

The circuit breaker 10 depicted in FIG. 1 is arranged for robotic assembly in a completely "downloaded" process wherein the circuit breaker operating mechanism 13 is assembled within the circuit breaker case 12 and the cover 11 is then attached to the case to complete the assembly process. This arrangement is described in the aforementioned U.S. Pat. No. 4,679,019 wherein the contact arm 15 is attached to the crossbar 14 in a subassembly within the circuit breaker case 12. The operating mechanism 13 which is similar to that described in the aforementioned U.S. Pat. No. 4,736,174 is then assembled to the crossbar by means of a pair of opposing mechanism side frames 9A, 9B. The operating handle 17 is attached to the handle yoke 18 by means of the handle skirt 20 to form the handle-yoke subassembly 44. When the operating mechanism is completely assembled within the case, the handle post 21 projects upward through the handle slot 19 formed within the cover when the cover is attached to the case. The circuit breaker trip actuator unit 16 is then inserted within a recess 8 formed in the circuit breaker cover to complete the assembly. A good description of the crossbar 14 is found within U.S. Pat. No 4,736,174 while a good description of the operating mechanism is found within U.S. Pat. No. 4,733,211. The trip actuator 16 is described in U.S. patent application Ser. No. 061,244 filed June 12, 1987 entitled "Molded Case Circuit Breaker Accessory Enclosure". The aforementioned U.S. Patents and Patent Application are incorporated herein for purposes of reference. Whereas the handle and yoke are assembled as separate entities within the aforementioned U.S. Pat. Application Ser. No. 061,244, the circuit breaker arrangement depicted in FIG. 1 attaches the handle-yoke subassembly 44 in a single step to the operating mechanism 13. The operating handle 17 and handle yoke 18 are attached together to form a handle-yoke subassembly 44 in an off-line preassembly process in the manner best seen by referring to FIGS. 2 and 5.

Figures 2, 5:
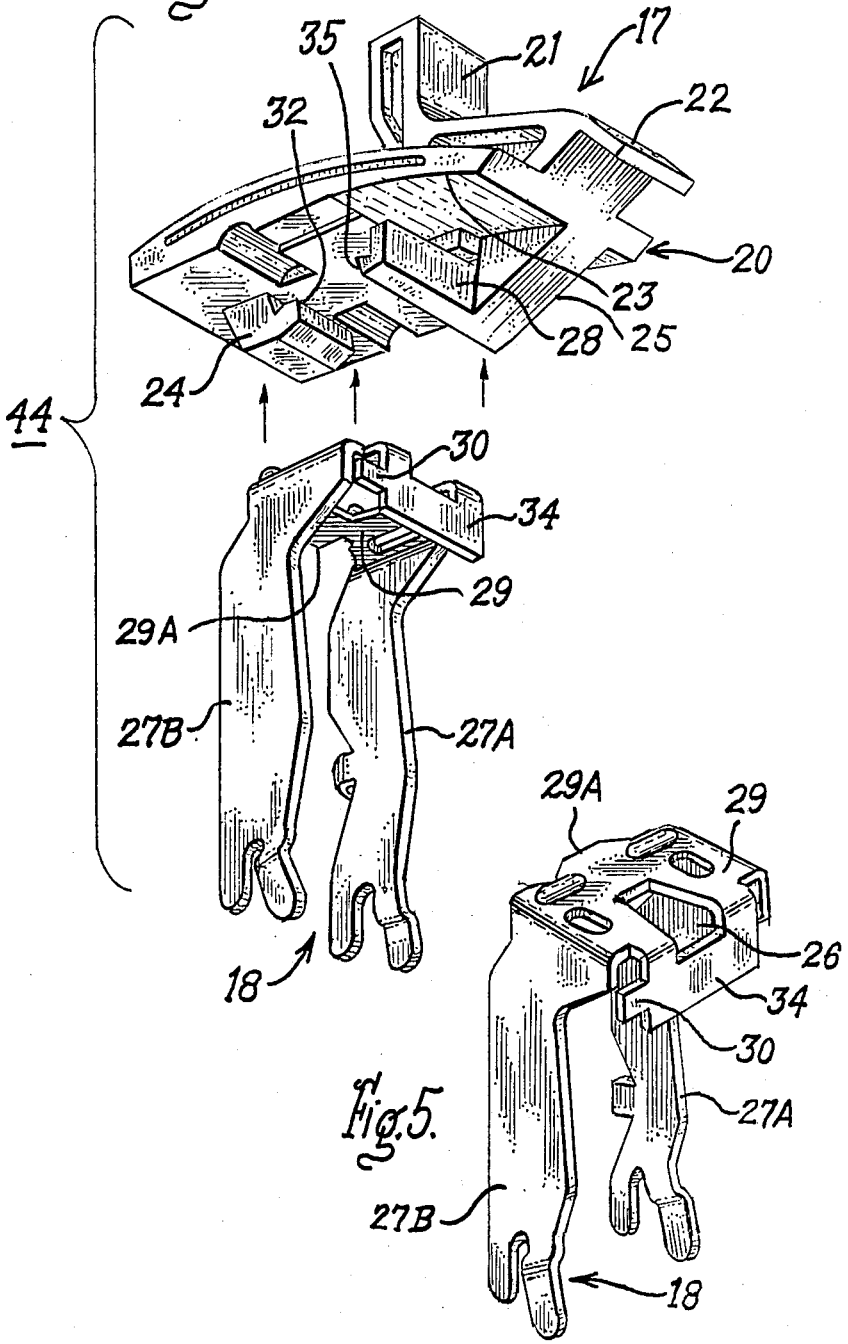
FIG. 2 is a bottom perspective view of the circuit breaker operating handle prior to engagement with the handle yoke.
FIG. 5 is a top perspective view of the handle yoke depicted in FIG. 2

The handle post 21 on the operating handle 17 is integrally-formed from a plastic composition with a handle skirt 20 having a top arcuate surface 22 and a bottom arcuate surface 23. This configuration is similar to that described within the aforementioned U.S. patent application Ser. No. 060,576 and differs therefrom by inclusion of a projection 24 having a hook 32 formed therein, oppositely-adjacent a flexible arm 28 that extends from a ramp-shaped projection 25 formed on the bottom surface thereof and terminating at its free end with an L-shaped hook 35. The yoke 18 as depicted in FIGS. 1 and 5 is formed from a single metal stamping with a top planar member 29 interconnecting between a pair of downwardly depending legs 27A, 27B. A V-shaped slot 26 is formed within the top member 29 to allow some flex to occur between the yoke legs 27A, 27B. A downwardly depending planar extension 34 is formed on the top member and includes a tab 30 extending from one end thereof. When the handle 17 is attached to the yoke 18, an overhang 29A formed on the end of the top member 29 is first trapped under the hook-shaped projection 24 and the handle 17 is rotated in a clockwise direction to bring the L-shaped hook 35, at the end of the flexible arm 28, into contact with the tab 30 formed on the extension 34. Continued rotation of the operating handle then causes the flexible arm 28 to move in the forward indicated direction and allow the L-shaped hook to slide under the tab. The flexible arm then returns to its initial position.

Figure 3A:
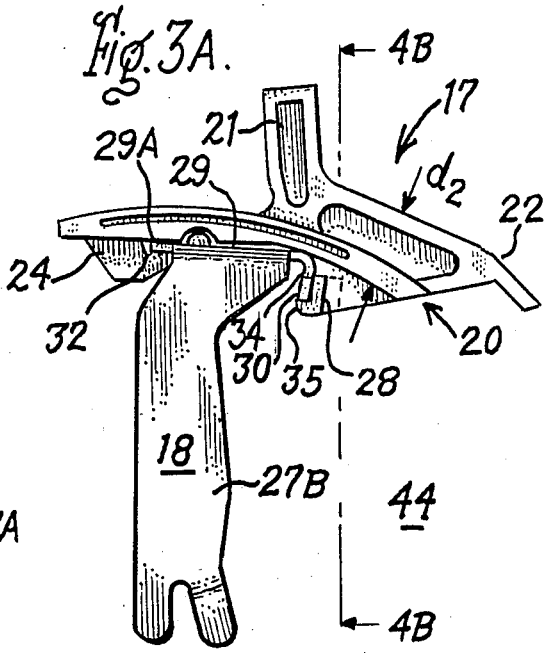
FIG. 3A is a side view of a circuit breaker operating handle and yoke according to the invention.
Figure 3B:
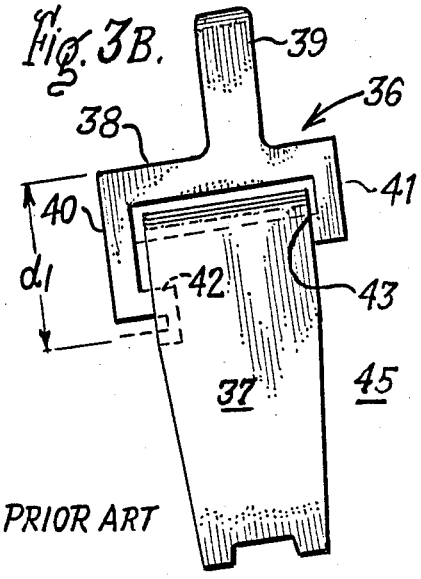
FIG. 3B is a side view of the circuit breaker operating handle attached to the handle yoke according to the prior art.

The engagement between the L-shaped hook 35 and the tab 30 is best seen by now referring to FIG. 3A wherein the handle-yoke subassembly 44 is depicted in a unitary assembly. The hook 32 formed on the hook-shaped projection 24 seats under the overhang 29A at one end of the top member 29. The tab 30, formed on the downwardly depending extension 34 is trapped under the L-shaped hook 35 formed at the end of the flexible arm 28. This arrangement differs from the prior art configuration 45 depicted in FIG. 3B wherein the prior art operating handle 39 is formed from a plastic material and wherein the prior art skirt 38 defines in a forward depending leg 41 terminating at its free end in a hook 43 integrally-formed therein. The prior art handle skirt 38 also defines a rear leg 40 which terminates in an integrally-formed hook 42 at its free end thereof. It is noted that the distance $d_1$ defined between the top surface of the prior art handle skirt 38 and the bottom of the leg 40 is larger than the distance $d_2$ between the handle operating skirt 20 of the inventive handle-yoke subassembly 44 depicted in FIG. 3A. Referring back to the prior art assembly 45 in FIG. 3B, it is noted that the prior art leg 40 is deflected in the vertical plane as also indicated in phantom to allow for the engagement between the hook 42 and the prior art yoke 37. As best seen by referring once again to the inventive handle-yoke subassembly 44 of FIG. 3A the distance $d_2$ prohibits the extension of the flexible arm 28 in the vertical plane and hence is displaced in the horizontal plane, parallel to the depending extension 34 (FIG. 2) as also indicated in phantom in FIG. 3A.

Figure 4B:
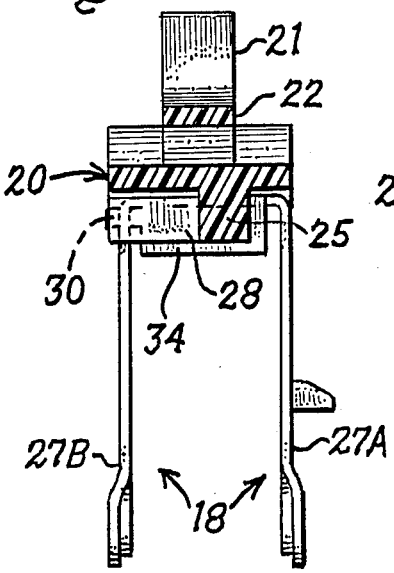
FIGS. 4A and 4B are front and rear views of the circuit breaker operating handle and yoke assembly of FIG. 3B.
Figure 4A:
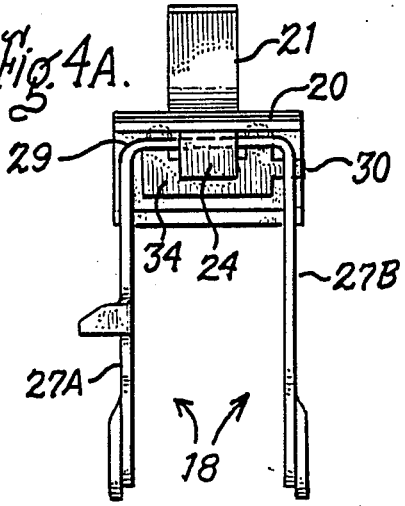

The assembled inventive handle-yoke subassembly is depicted in FIGS. 4A and 4B to detail the engagement between the hook-shaped projection 24 on one end of the handle skirt 20 and the top member 29 of the handle yoke 18. The trapping of the extension 30 of the handle yoke 18 behind the flexible arm 28 formed on the handle skirt 20 is detailed in FIG. 4B. Besides allowing the automated attachment of a single handle-yoke subassembly 44 to the circuit breaker operating mechanism 13, depicted earlier in FIG. 1, the handle is held secure to the mechanism and is prevented from becoming detached during the remainder of the automatic assembly process.

Although the handle is shown being assembled as a handle-yoke subassembly prior to attachment to the circuit operating mechanism, this is by way of example only. It is to be clearly understood that the handle yoke can be first attached to the circuit breaker operating mechanism prior to the attachment of the handle to the handle yoke in some high speed manufacturing assembly process, if so desire.

Having thus described my invention, what I claim as new and desire to secure by Letters Patent is:

1. A molded case circuit breaker operating handle assembly comprising:

a molded plastic handle including a handle post extending from a top surface thereon;

a hook member integrally formed with and extending from one end of a bottom surface of said plastic handle;

a flexible arm supported on an opposite end of said bottom surface and extending parallel with said bottom surface; and a projection on an end of said arm extending a predetermined distance from said arm.

2. The molded case circuit breaker operating handle assembly of claim 1 wherein said top surface comprises a curvilinear configuration.

3. The molded case circuit breaker operating handle assembly of claim 1 wherein said bottom surface comprises a curvilinear configuration.

4. The molded case circuit breaker operating handle assembly of claim 1 wherein said arm flexes in a first plane parallel with said bottom surface.

5. The molded case circuit breaker operating handle assembly of claim 1 including a handle yoke attached to said bottom surface.

6. The molded case circuit breaker operating handle assembly of claim 5 wherein said handle yoke comprises a pair of parallel legs joined by a planar top member.

7. The molded case circuit breaker operating handle assembly of claim 6 wherein said planar member terminates at one end in a downwardly extending plate.

8. The molded case circuit breaker operating handle assembly of claim 7 wherein said planar member terminates at an opposite end in an overhang.

9. The molded case circuit breaker operating handle assembly of claim 7 wherein said plate includes a tab extending therefrom.

10. The molded case circuit breaker operating handle assembly of claim 7 wherein said planar member is captured between said hook member and said arm.

11. The molded case circuit breaker operating handle assembly of claim 9 wherein said projection on said arm captures said tab on said plate.

12. The molded case circuit breaker operating handle assembly of claim 8 wherein said hook member on said bottom surface captures said overhang on said planar member.

13. A method of attaching a circuit breaker handle to a handle yoke comprising the steps of:

positioning one end of a plate on said handle yoke under a hook formed on said handle;

rotating said handle yoke and said plate to bring a tab on said plate into contact with a projection extending from an arm on said handle;

displacing said projection away from said tab to position said plate under said handle; and positioning said projection under said tab to secure said handle yoke to said handle.

14. The method of claim 13 wherein said step of displacing said projection comprises flexing said arm in a plane parallel with said plate.

* * * * *